United States Patent [19]

Roland

[11] Patent Number: 4,805,909

[45] Date of Patent: Feb. 21, 1989

[54] SCORE KEEPING APPARATUS

[76] Inventor: Homer L. Roland, 205 N. Murray, #46, Colorado Springs, Colo. 80916

[21] Appl. No.: 179,334

[22] Filed: Apr. 8, 1988

[51] Int. Cl.[4] ..... A63F 1/16

[52] U.S. Cl. ..... 273/148 R; 116/325; 235/90

[58] Field of Search ..... 273/148 R, 148 A; 116/325; 235/90

[56] References Cited

U.S. PATENT DOCUMENTS

| | | | |
|---|---|---|---|
| 766,545 | 8/1904 | Sterl | 273/148 A |
| 949,379 | 2/1910 | Patriarche | 273/148 R |
| 2,570,535 | 10/1951 | Faber et al. | 273/148 R UX |
| 3,347,460 | 10/1967 | Dickson | 235/90 |
| 3,520,536 | 7/1970 | Kindelan | 273/148 R X |
| 4,073,493 | 2/1978 | Moreland | 273/148 R |
| 4,332,386 | 6/1982 | Townsend | 273/148 A |

*Primary Examiner*—Anton O. Oechsle
*Attorney, Agent, or Firm*—Henderson & Sturm

[57] ABSTRACT

A score keeping apparatus (10) for games comprising a clipboard unit (11) adapted to operatively engage a score pad unit (12) and a sequence monitoring unit (13) operatively associated with the clipboard unit (11); wherein the sequence monitoring unit (13) includes a movable peg member (31) and a plurality of apertures (30) arranged in a pattern (40) for the purpose of keeping track of the order of rotation among the participants in a game.

16 Claims, 1 Drawing Sheet

FIG. 1.
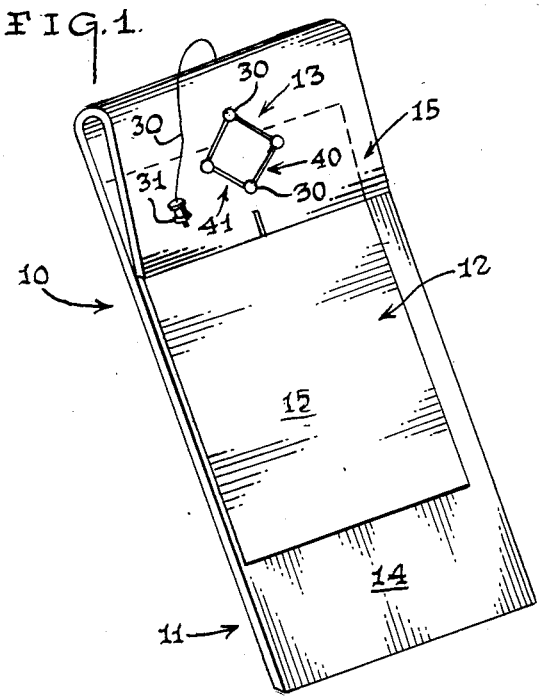
FIG. 2.
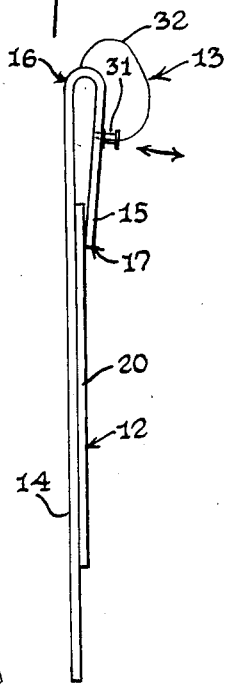
FIG. 3.
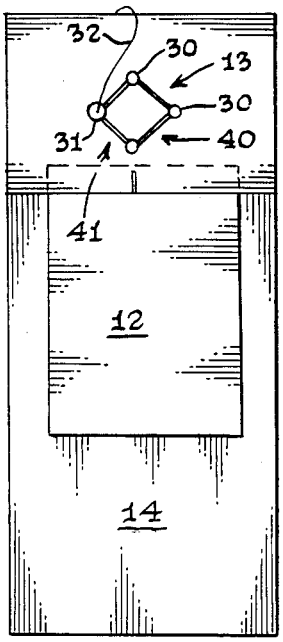
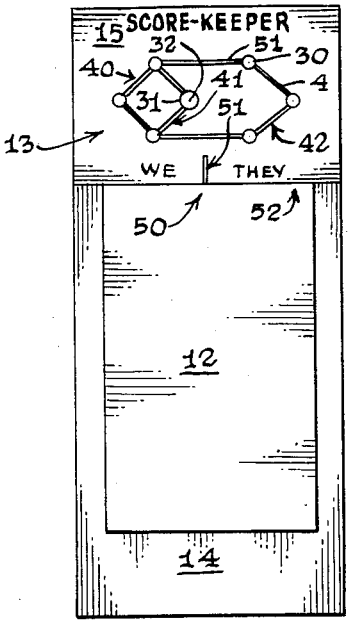
FIG. 4.
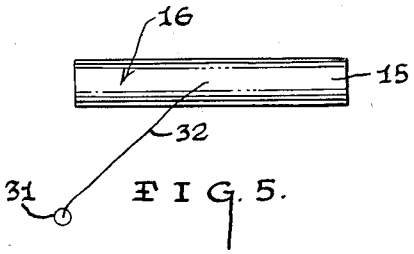
FIG. 5.
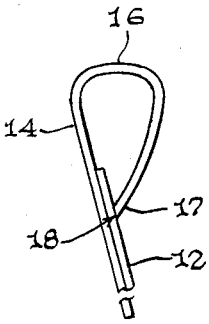
FIG. 6.

SCORE KEEPING APPARATUS

TECHNICAL FIELD

The present invention relates to score keeping devices for games in general and more specifically to a score keeping apparatus for card and dominoe players in particular.

BACKGROUND OF THE INVENTION

As can be seen by reference to the following U.S. Pat. Nos.: 4,332,386; 4,073,493; 3,347,460; and 3,520,536 the prior art is replete with myriad and diverse score keeping constructions which employ one or more pegs which cooperate with a plurality of apertures to keep score and/or track the progress of the participants relative to a game board.

While all of the aforementioned prior art constructions are undoubtedly more than adequate for the particular purpose and function for which they have been specifically designed, these devices are neither suited for, nor adaptable for use as a score keeping arrangement that will not only provide a surface upon which scores can be registered; but, will also possess means whereby the order of card shuffling or sequence of play can be monitored.

Obviously there has existed a longstanding need for an apparatus that will fulfill the aforementioned functional parameters, and the present invention was specifically developed with the foregoing objectives in mind.

BRIEF SUMMARY OF THE INVENTION

Briefly stated, the score keeping apparatus that forms the basis of the present invention comprises in general: a clipboard unit; a sequence monitoring unit; and a score pad unit.

As will be explained in greater detail further on in the specification the clipboard unit comprises a support member and a flexible clip member that are adapted to releasably engage the score pad unit; wherein, the sequence monitoring unit is operatively associated with the clipboard unit.

The sequence monitoring unit comprises in general: a plurality of sequence apertures that are spaced from one another and arranged in a pattern representative of the rotation of responsibility for one aspect of the game that will fall on the shoulders of one among up to six participants in the game. In addition, the sequence monitoring unit further comprises a movable peg member that is adapted to cooperate with the sequence apertures in a selected and sequential movement among the adjacent apertures; wherein, the peg member is operatively connected to the clipboard unit by a tether element to prevent the loss of the peg member from the apparatus.

BRIEF DESCRIPTION OF THE DRAWINGS

These and other objects, advantages, and novel features of the invention will become apparent from the detailed description of the best mode for carrying out the preferred embodiment of the invention which follows; particularly when considered in conjunction with the accompanying drawings, wherein:

FIG. 1 is a perspective view of one version of the preferred embodiment of the invention;

FIG. 2 is a side plan view of the score keeping apparatus;

FIG. 3 is a front plan view of the first version of the apparatus;

FIG. 4 is a front plan view of another version of the preferred embodiment of the apparatus;

FIG. 5 is a top plan view of the apparatus; and,

FIG. 6 is an enlarged detail view of the cooperation between the clipboard unit and the score pad unit.

BEST MODE FOR CARRYING OUT THE INVENTION

As can be seen by reference to the drawings and in particular to FIG. 1, the score keeping apparatus that forms the basis of the present invention is designated generally by the reference numeral (10). The score keeping apparatus (10) comprises in general: a clipboard unit (11); a score pad unit (12); and, a sequence monitoring unit (13). These units will now be described in seriatim fashion.

As can best be seen by reference to FIGS. 1 and 2, the clipboard unit (11) comprises a generally elongated flat rectangular board member (14) provided with a clip member (15) on its upper end. In the preferred embodiment of this invention the board member (14) and the clip member (15) are fabricated from generally rigid yet flexible material such as plastic, or the like, and the board member (14) and clip member (15) are formed integrally with one another.

As shown in FIGS. 2 and 6, the clip member (15) comprises an outwardly and downwardly curved extension of the board member (14); wherein, the curved transition portion (16) between the board member (14) and the downwardly depending clip member (15) serves as a flexible hinge element that allows the free end (17) of the clip member (15) to be laterally flexed away from engagement with the board member (14).

In addition, as clearly shown in FIG. 6, the free end (17) of the clip member (15) may optionally be provided with an inwardly beveled surface (18); such that the beveled surface (18) will be normally disposed in a generally parallel relationship with the face of the board member (14), for reasons that will be described presently.

Turning now to FIGS. 1 thru 4, it can be seen that the score pad unit (12) comprises at least one score sheet (20) that is adapted to be clasped between the free end (17) of the clip member (15) and the face of the board member (14); however, in the preferred embodiment of the invention the score pad unit (12) is intended to comprise a plurality of score sheets (20) having one of their ends joined in a well recognized manner to form a score pad (20).

Referring back to FIG. 6, it can be appreciated that the beveled edge (18) of the clip member (15) is provided to increase the surface area engagement of the clip member (15) relative to the top score sheet (19) on the score pad (20) to increase the frictional engagement of the clipboard unit (11) with the score pad unit (12).

As can best be seen by reference to FIGS. 1 thru 3, the sequence monitoring unit (13) comprises a plurality of discrete sequence apertures (30) that are formed in the clipboard unit (11). Furthermore, the sequence apertures (30) that are spaced from one another and arranged in a generally diamond shaped pattern designated generally as (40); wherein, the pattern (40) is representative of the rotation of responsibility for one aspect of a game such as cards, dominoes, or the like; and wherein the responsibility in question is shifted in a sequential rotation among a plurality of the game participants.

In addition, the sequence monitoring unit (13) further comprises a movable peg member (31) that is adapted to be received in the sequence apertures (30); wherein, the peg member (31) is operatively attached to the clipboard unit (11) by an elongated tether member (32) which is: secured on one end to the clipboard unit (11); secured on its other end to the peg member (31); and has a length sufficient to allow the movement of the peg member (31) among the plurality of sequence apertures (30).

In the first version of the preferred embodiment illustrated in FIGS. 1 and 3, the diamond shaped pattern (40) comprises a four sided diamond (41); wherein, the plurality of sequence apertures (30) comprise four apertures (30) that are disposed at the juncture of the sides of the four sided diamond pattern.

In the second version of the preferred embodiment depicted in FIG. 4, the diamond shaped pattern (40) comprises an enlarged six sided diamond pattern (42) that optionally encompasses a four sided diamond pattern (41); wherein the plurality of sequence apertures (30) comprise a minimum of six apertures that are disposed at the juncture of the sides of the six sided diamond pattern (42); and wherein at least a seventh aperture (30) would be required to encompass the optional four sided diamond pattern (41) within the six sided diamond pattern (42).

As can best be seen by reference to FIG. 4, the clipboard unit (11) is further provided with indicia designated generally as (50) wherein the indicia (50) comprise lines (51) interconnecting the plurality of sequence monitoring apertures (30); and a single line (51) vertically bisecting the free end (17) of the clip member (15) to provide an imaginary dividing line to create two columns on the score pad unit (12). In addition, the indicia (50) is intended to comprise printed legends (52) including words such as "we" and "they", and phrases such as "who shuffled last" for the purposes of keeping track both of the score on the score pad unit (12) and also the progression of the shuffle around the table.

Since many popular card games such as bridge and spades only involve four participants, the four sided diamond version illustrated in FIGS. 1 and 3 comprises the preferred embodiment of the invention. However, since other card games such as canasta, poker, etc. may involve as many as six participants, and in only rare circumstances more than six participants, the six sided diamond configuration illustrated in FIG. 4 represents the alternate form of the preferred embodiment.

Having thereby described the subject matter of this invention it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A score keeping apparatus for keeping track of both the sequence of play and the score of a game wherein the apparatus comprises in general:

a clipboard unit; and, a sequence monitoring unit operatively associated with the clipboard unit and comprising a movable peg member and a plurality of discrete apertures formed in the clipboard unit; wherein, the plurality of discrete apertures are arranged in a pattern representative of the rotation of a given responsibility attendant upon the participants in a particular game.

2. The apparatus as in claim 1 further comprising:

a score pad unit operatively associated with the clipboard unit.

3. The apparatus as in claim 2 wherein the score pad unit comprises at least one score sheet.

4. The apparatus as in claim 2 wherein the score pad unit comprises a plurality of individual score sheets.

5. The apparatus as in claim 2 wherein the clipboard unit comprises:

a generally elongated flat rectangular board member provided with a clip member on the upper end of the board member.

6. The apparatus as in claim 5 wherein the clip member comprises an outwardly and downwardly curved extension of the board member.

7. The apparatus as in claim 6 wherein the curved transition portion between the board member and the downwardly extending clip member serves as a flexible hinge element that permits the score pad unit to be captively engaged between the board member and the clip member.

8. The apparatus as in claim 2 wherein the said pattern of the plurality of apertures represents at least one diamond shape.

9. The apparatus as in claim 8 wherein the plurality of apertures are disposed at the juncture of the sides of the diamond pattern.

10. The apparatus as in claim 8 including a pattern representative of a four sided diamond.

11. The apparatus as in claim 8 including a pattern representative of a six sided diamond.

12. The apparatus as in claim 8 including a pattern representative of both a four sided and a six sided diamond.

13. The apparatus as in claim 1 wherein said movable peg member is operatively associated with the clipboard unit by an elongated tether.

14. The apparatus as in claim 1 further comprising indicia extending between the discrete apertures and legends associated with the clipboard unit.

15. The apparatus as in claim 14 wherein the indicia comprise a plurality of lines interconnecting the said discrete apertures and a single line bisecting a portion of the clipboard unit.

16. The apparatus as in claim 14 wherein the legends comprise individual words and at least one phrase.

* * * * *